US005713973A

United States Patent [19]

Yoshida et al.

[11] Patent Number: 5,713,973

[45] Date of Patent: Feb. 3, 1998

[54] CLEAN AIR DUCT DEVICE

[75] Inventors: Kiyomi Yoshida; Fumiyuki Iwano; Michio Ueda, all of Itano-gun, Japan

[73] Assignee: Shikoku Kakoki Co., Ltd., Itano-gun, Japan

[21] Appl. No.: 555,747

[22] Filed: Nov. 9, 1995

[30] Foreign Application Priority Data

Nov. 14, 1994 [JP] Japan ..... 6-278878

[51] Int. Cl.[6] ..... B01D 27/06

[52] U.S. Cl. ..... 55/497; 55/502; 55/521

[58] Field of Search ..... 55/467, 473, 483, 55/499, 502, 503, 497, 521

[56] References Cited

U.S. PATENT DOCUMENTS

| | | | |
|---|---|---|---|
| 3,247,652 | 4/1966 | Annas et al. | 55/502 X |
| 3,696,592 | 10/1972 | Engleman | 55/521 X |
| 3,757,499 | 9/1973 | Scott | 55/521 X |
| 3,808,777 | 5/1974 | Neumann et al. | 55/502 X |
| 4,032,310 | 6/1977 | Ignoffo | 55/503 X |
| 4,344,784 | 8/1982 | Deckas et al. | 55/502 X |

*Primary Examiner*—Harold Joyce
*Attorney, Agent, or Firm*—Armstrong, Westerman, Hattori, McLeland & Naughton

[57] ABSTRACT

A clean air duct device comprises a duct (11) having a positive-pressure air channel (21), and a filter (12) provided between the inlet (24) and the outlet (31) of the duct. The filter (12) comprises a filter medium (41), and a frame (43) surrounding the medium (41) and having an upstream mount flange (45) along an edge portion thereof defining an upstream opening (44) and a downstream mount flnage (47) along an edge portion thereof defining a downstream opening (46). The duct (11) comprises an upstream duct member (22) and a downstream duct member (23). The upstream duct member (22) is provided at an outlet end thereof with an upstream communication opening (26) shaped in conformity with the shape of the frame upstream opening (44), and the downstream duct member (23) is provided at an inlet portion thereof with a downstream communication opening (33) shaped in conformity with the shape of the frame downstream opening (46). The upstream communication opening (26) has an upstream joint flange (28) along its edge portion, and the downstream communication opening (33) has a downstream joint flange (35) along its edge portion. The upstream mount flange (45) and the upstream joint flange (28) are connected together with an upstream packing (51) interposed therebetween, and the downstream mount flange (47) and the downstream joint flange (35) are connected together with a downstream packing (52) interposed therebetween.

4 Claims, 3 Drawing Sheets

CLEAN AIR DUCT DEVICE

BACKGROUND OF THE INVENTION

The present invention relates to a clean air duct device which is useful, for example, for the clean air room to be provided in pharmaceutical plants, food plants, atomic power facilities, etc. or for the air cleaner to be installed for aseptic filling-packaging machines.

FIG. 3 shows such a device already known and comprising a duct 62 having a positive-pressure air channel 61, and a HEPA filter (high efficiency particulate air filter) 63 interposed between the inlet and the outlet of the duct 62. The filter 63 comprises a filter medium 64 and a frame 65 surrounding the filter medium 64 and having a mount flange 66 along a downstream opening edge portion thereof. The duct 62 is formed inside thereof with an inwardly projecting filter support 67, and the mount flange 66 is placed on the filter support 67 with a packing 68 interposed therebetween. The mount flange 66, the packing 68 and the support 67 are fastened together by clamps 69.

When trouble occurs in the sealing property of the packing 68 of the device, air on the upstream side of the filter 63 leaks through the packing 68 and flows to the downstream side without passing through the filter 63 as indicated by arrows C in FIG. 3, contaminating the air on the downstream side. Since the contamination of the downstream air leads directly to the contamination of the product to be obtained, it is important to completely eliminate the leak through the packing 68 for the prevention of contamination.

Various measures are taken to prevent the leak through the packing 68. These measures include working on the surface of the filter support 67 with improved accuracy to obviate undulations, warping or irregularities of the surface of the support 67; giving an enhanced structural strength to the duct 62 to preclude deformation of the filter support 67; using a special clamp mechanism for clamping the packing 68 with a uniform pressure; and tightening the clamps for the packing 68 periodically for maintenance.

These measures are effective to improve the sealing property of the packing 68 but still fail to completely eliminate the contamination of the air on the downstream side of the filter 63.

SUMMARY OF THE INVENTION

An object of the present invention is to provide a clean air duct device adapted to completely eliminate the contamination of the air on the downstream side of the filter.

The present invention provides a clean air duct device which comprises a duct having a positive-pressure air channel, an inlet and an outlet, and a filter provided between the inlet and the outlet of the duct, the filter comprising a filter medium and a frame surrounding the filter medium, the frame having an upstream mount flange along an edge portion thereof defining an upstream opening, the frame having a downstream mount flange along an edge portion thereof defining a downstream opening, the clean air duct device being characterized in that the duct comprises an upstream duct member and a downstream duct member, the upstream duct member being provided at an outlet end thereof with an upstream communication opening shaped in conformity with the shape of the upstream opening of the frame, the downstream duct member being provided at an inlet end thereof with a downstream communication opening shaped in conformity with the shape of the downstream opening of the frame, the upstream communication opening being provided with an upstream joint flange along its edge portion, the downstream communication opening being provided with a downstream joint flange along its edge portion, the upstream mount flange and the upstream joint flange being connected together with an upstream packing interposed therebetween, the downstream mount flange and the downstream joint flange being connected together with a downstream packing interposed therebetween.

With the clean air duct device of the present invention, the duct comprises an upstream duct member and a downstream duct member, the upstream duct member being provided at an outlet end thereof with an upstream communication opening shaped in conformity with the shape of the upstream opening of the frame, the downstream duct member being provided at an inlet end thereof with a downstream communication opening shaped in conformity with the shape of the downstream opening of the frame, the upstream communication opening being provided with an upstream joint flange along its edge portion, the downstream communication opening being provided with a downstream joint flange along its edge portion, the upstream mount flange and the upstream joint flange being connected together with an upstream packing interposed therebetween, the downstream mount flange and the downstream joint flange being connected together with a downstream packing interposed therebetween, so that this construction has the following feature. Even if trouble occurs in the sealing property of the upstream packing, air on the upstream side of the filter will be caused to leak through the packing to flow out from the duct, while, when the downstream packing develops trouble, air on the downstream side of the filter will leak through this packing to flow out from the duct.

The invention therefore completely eliminates the contamination of the air on the downstream side of the filter due to the flow of air from the upstream side of the filter to the downstream side thereof. Furthermore, there is no need to take the foregoing measures for preventing the leak through the packing.

DESCRIPTION OF THE PREFERRED EMBODIMENT

Figure 1:
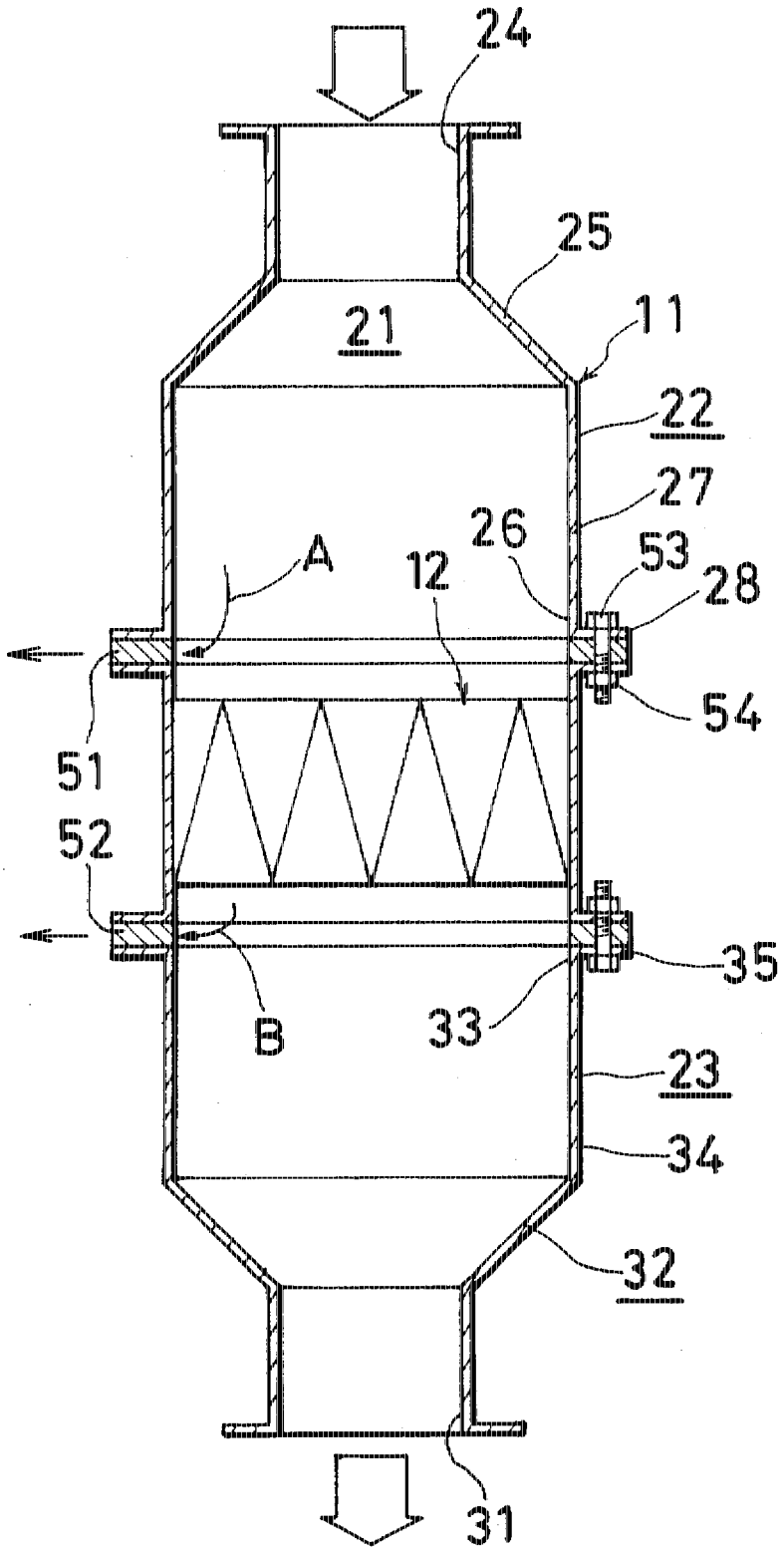
FIG. 1 is a view in vertical longitudinal section of a clean air duct device embodying the invention.

An embodiment of the invention will be described below with reference to FIGS. 1 and 2.

The clean air duct device shown comprises a vertical duct 11, and a HEPA filter 12 disposed in the duct 11 at an intermediate portion of its height.

The duct 11 has a downward positive-pressure air channel 21 and comprises an upper duct member 22 and a lower duct member 23. The upper duct member 22 comprises an upper portion 25 tapered upward with a decreasing channel cross sectional area and having an open inlet 24 at its upper end, and a lower portion 27 in the form of a tube of constant rectangular channel cross section and having a rectangular upper communication opening 26 at its lower end. The upper communication opening 26 is provided with an upper joint flange 28 along its edge portion. The lower duct member 23 comprises a lower portion 32 tapered downward with a decreasing channel cross sectional area and having an open outlet 31 at its lower end, and an upper portion 34 in the form of a tube of constant rectangular channel cross section and having a rectangular lower communication opening 33 at its upper end. The lower communication opening 33 is provided with a lower joint flange 35 along its edge portion.

Figure 2:
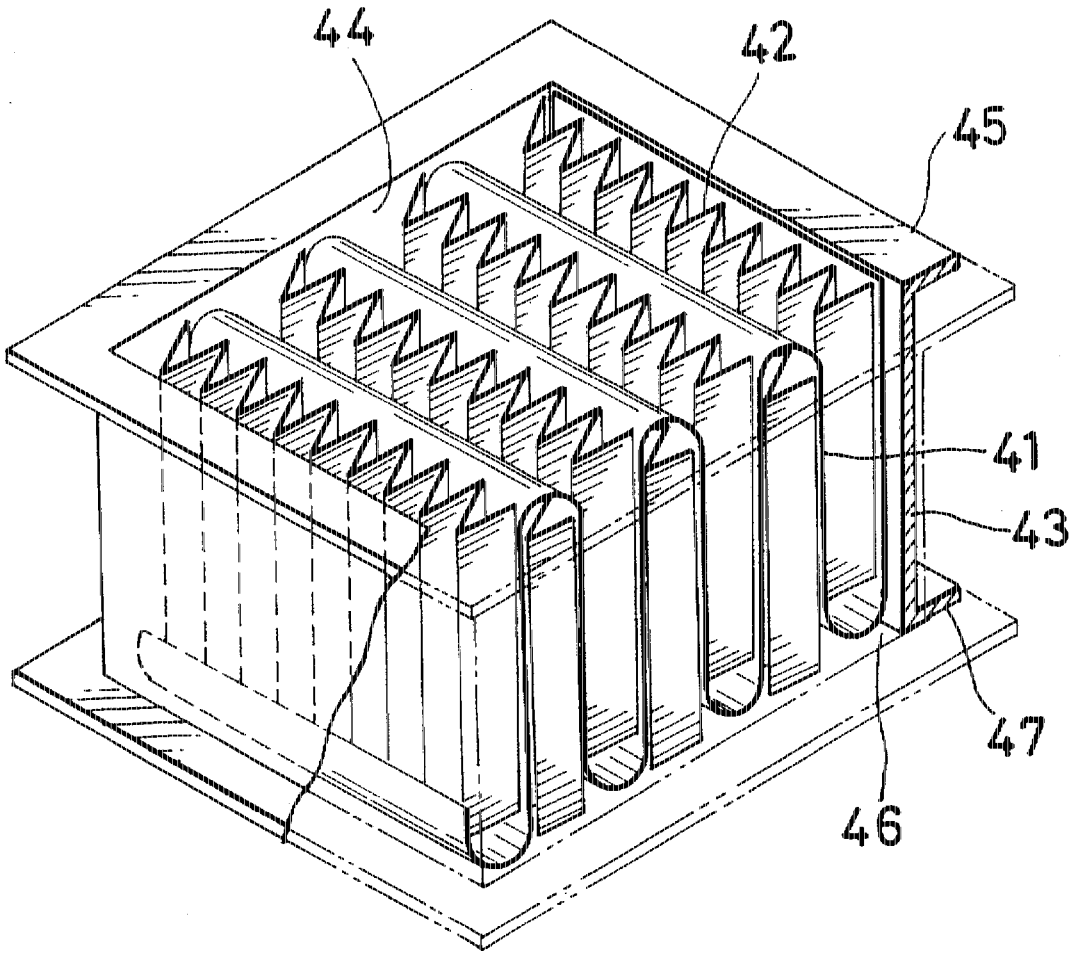
FIG. 2 is a perspective view of a filter utilized in the device.
Figure 3:
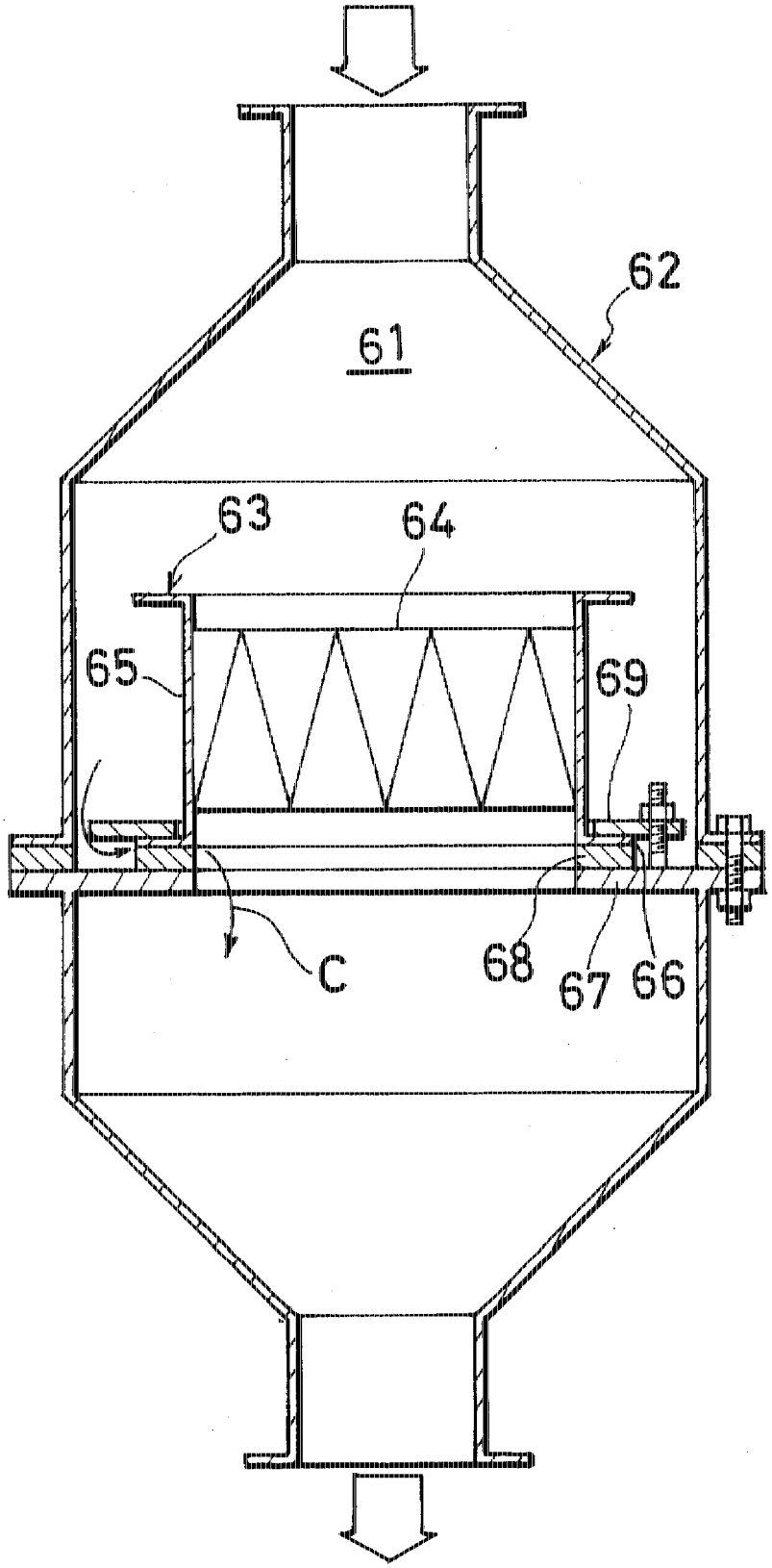
Fig. 3 PRIOR ART
FIG. 3 is a sectional view corresponding to FIG. 1 and showing a conventional device.

As shown in detail in FIG. 2, the filter 12 comprises a zigzag filter medium 41 of glass fiber extending alternately upward and downward to zigzag in the right-left direction, zigzag spacers 42 of aluminum plate each interposed between adjacent flat portions of the filter medium 41 and extending alternately rightward and leftward to zigzag from the front rearward, and a rectangular frame 43 prepared from a chromate-treated steel plate or stainless steel plate and surrounding the filter medium 41 and the spacers 42. The frame 43 has an upper mount flange 45 along an edge portion thereof defining an upper-end opening 44, and a lower mount flange 47 along an edge portion thereof defining a lower-end opening 46.

The upper communication opening 26, lower communication opening 33, frame upper-end opening 44 and frame lower-end opening 46 have the same shape. The upper joint flange 28, lower joint flange 35, upper mount flange 45 and lower mount flange 47 have the same shape.

The upper joint flange 28 is placed over the upper mount flange 45 with an annular upper packing 51 interposed therebetween to hold the upper communication opening 26 in communication with the frame upper-end opening 44. The lower mount flange 47 is placed over the lower joint flange 35 with an annular lower packing 52 interposed therebetween to hold the frame lower-end opening 46 in communication with the lower communication opening 33. The upper packing 51 and the lower packing 52 are both made of silicone sponge.

The upper joint flange 28, upper packing 51 and upper mount flange 45 are fastened by bolts 53 extending through these members and nuts 54. Similarly, the lower joint flange 35, lower packing 52 and lower mount flange 47 are fastened by bolts 53 extending through these members and nuts 54.

When trouble occurs in the sealing property of the upper packing 51, air above the filter 12 flows out from the duct 11 through the upper packing 51 as indicated by an arrow A in FIG. 1. If trouble occurs in the sealing property of the lower packing 52, air under the filter 12 flows out from the duct 11 through the lower packing 52 as indicated by an arrow B in FIG. 1. In other words, even in the event of trouble occurring in either one of the upper or lower packings 51, 52, the air inside the duct 12 merely flows out from the duct 11, and the air above the filter 12 in no way flows in to below the filter 12 because a positive pressure is maintained inside the duct 11.

What is claimed is:

1. A clean air duct defining a channel for conducting positive pressure air, said duct comprising:

an elongated upstream duct member forming the upstream portion of said channel and having an inlet at one end and an upstream communication opening at its other end defined by an outwardly offset joint flange of said duct member extending about said opening;

an elongated downstream duct member disposed in axial alignment with said upstream duct member in spaced relation therewith along the length of said channel, said downstream duct member having a downstream communication opening at one end thereof defined by an outwardly offset joint flange of said duct member extending about said opening in opposition to said joint flange of said upstream duct member, and an outlet at the other end thereof; and a filter having a frame extending between said upstream duct member and said downstream duct member, said frame having an upstream opening communicating with said upstream communication opening of said upstream duct member and a downstream opening communicating with said downstream communication opening of said downstream duct member, said frame further having an outwardly offset upstream mount flange extending about said upstream opening and whose shape conforms substantially with the shape of said joint flange of said upstream duct member, and an outwardly offset downstream mount flange extending about said downstream opening and whose shape conforms substantially with the shape of said joint flange of said downstream duct member;

means including packing for connecting said joint flanges of said duct members with said mount flanges of said filter frame; and a body of filter medium extending between oppositely spaced walls across the interior of said filter frame, whereby all positive pressure air conducted through said upstream duct member is conducted either through said body of filter medium or passed as leakage through said connecting means to the exterior of said duct.

2. A clean air duct device according to claim 1 in which said body of filter material includes a fiber filter material and a spacer defined by a rigid zig-zag plate material forming a plurality of passages directed parallel to the direction of air flow through said frame disposed in each of said filter material passages.

3. The clean air duct device according to claim 2 in which said fiber material is glass fiber.

4. The clean air duct device according to claim 2 in which said plate material is aluminum.

* * * * *